United States Patent [19]

Pirc

[11] Patent Number: 4,804,332

[45] Date of Patent: Feb. 14, 1989

[54] FILTERED ELECTRICAL DEVICE AND METHOD FOR MAKING SAME

[75] Inventor: Douglas J. Pirc, Etters, Pa.

[73] Assignee: Amp Incorporated, Harrisburg, Pa.

[21] Appl. No.: 225,652

[22] Filed: Jul. 25, 1988

Related U.S. Application Data

[63] Continuation of Ser. No. 98,725, Sep. 15, 1987, abandoned, which is a continuation of Ser. No. 946,476, Dec. 24, 1986, abandoned.

[51] Int. Cl.[4] ..... H01R 13/66

[52] U.S. Cl. ..... 439/620; 29/832; 333/182

[58] Field of Search ..... 439/607-610, 439/620; 339/143 R, 147 R, 147 P; 333/181-184; 29/827, 832, 842, 848, 854, 883

[56] References Cited

U.S. PATENT DOCUMENTS

| | | | |
|---|---|---|---|
| 4,187,481 | 2/1980 | Boutros | 333/182 |
| 4,215,326 | 7/1980 | Hollyday | 333/182 |
| 4,265,506 | 5/1981 | Hollyday | 339/147 |
| 4,337,574 | 7/1982 | Hughes et al. | 29/883 |
| 4,376,922 | 3/1983 | Muzslay | 333/182 |
| 4,500,159 | 5/1985 | Briones et al. | 339/147 R |
| 4,580,866 | 4/1986 | Hagner | 339/147 |
| 4,582,385 | 4/1986 | Couper et al. | 339/147 R |
| 4,600,256 | 7/1986 | Anttila | 339/147 R |
| 4,600,262 | 7/1986 | Nieman et al. | 333/182 |

FOREIGN PATENT DOCUMENTS

| | | |
|---|---|---|
| 0211508A1 | 2/1987 | European Pat. Off. . |
| 3528498A1 | 2/1987 | Fed. Rep. of Germany . |
| 5624986 | 2/1981 | Japan . |
| 2169157A | 7/1986 | United Kingdom . |

OTHER PUBLICATIONS

Japanese Applicaton Sho 57/1982-140047, 8-1982, Inventor: A. Imai.

*Primary Examiner*—Neil Abrams
*Attorney, Agent, or Firm*—Katherine A. Nelson

[57] ABSTRACT

A filtered electrical device 10 for being secured externally to an electrical article such as an electrical connector and electrically engageable to circuit paths thereof comprises a plurality of contact members 12, a housing member 40 having a plurality of filter receiving apertures 48 therein, a plurality of filter receiving apertures 48 therein, a plurality of filter members 54 disposed in the apertures 48 and electrically connected to the contact members 12 and a ground means. The contact members 12 have first and second contact portions 14, 24, the first contact portions 14 being secured in the housing 40 and engageable with corresponding contact sections of the elctrical article to which the filtering device 10 is secured. The second contact portions 24 are exposed along a bottom surface 50, of respective apertures 48 and are paired with and spaced from third contact portions 30 which are also exposed along a bottom apertures surface 50. Ground means include a bus means 34 secured in the housing 40 and extending outwardly from third contact sections 30. Filter members 54 are electrically engaged to respective pairs of second and third contact portions 14, 24. The device 10 can be manufactured in a continuous form by stamping a series of contact means in a strip 58 of metal, insert molding housing member 40 are desired length around a plurality of the contact means 70 to form a series of severable lead frames 60, placing filter members 54 in the filter receiving apertures 48, and severing individual devices 10. Alternatively, the strip of devices 10 can be stored in reel form until they are to be used.

26 Claims, 7 Drawing Sheets

FILTERED ELECTRICAL DEVICE AND METHOD FOR MAKING SAME

This application is a continuation of application Ser. No. 098,725 filed 9/15/87, now abandoned, in turn a continuation of application Ser. No. 946,476 filed 12/24/86 now abandoned.

FIELD OF THE INVENTION

This invention relates to electrical connectors and more particularly to filtered electrical connectors and filtering devices for providing protection against electromagnetic interference and radio frequency interference.

BACKGROUND OF THE INVENTION

Electrical circuitry often must be protected from disruptions caused by electromagnetic intereference (EMI) and radio frequency interference (RFI) entering the system.

In addition to protecting electronic equipment against EMI/RFI energy, there is also a need to protect the equipment against power surges owing to electrostatic discharges (ESD) and electromagnetic pulse (EMP). The high voltage generated by ESD and EMP can damage voltage sensitive integrated circuits and the like.

Frequently today's electronic circuitry requires the use of high density, multiple contact electrical connectors. There are many applications in which it is desirable to provide a connector with a filtering capability, for example, to suppress EMI and RFI. To retain the convenience and flexibility of the connector, however, it is desirable that the filtering capability be incorporated into connectors in a manner that will permit full interchangability between the connectors and their unfiltered counterparts. In particular, any filter connector should also in many instances retain substantially the same dimensions as the unfiltered version and should have the same contact arrangement so that either can be connected to an appropriate mating connector. Additionally it is sometimes desirable to filter only certain lines within a connector and to use the same basic connector in a number of applications, each requiring different selected lines to be filtered.

One means to protect against undesirable interference without altering the internal structure of a connector is by the use of shielding. The shielding may take several forms. For adequate protection, it is essential, however, that there be no break in continuity of the shielding.

Other means for protecting against interference include the use of internal filtering schemes which include the use of filter sleeves and planar filter members. Both of these methods generally require the additional space within the connector to accommodate the sleeves or other filtering devices. Furthermore, connectors of this type often include a number of labor intensive steps during the manufacture of the connectors. These connectors are not readily manufacturable by automatic equipment.

In many instances it is desirable to have an external filtering device that is an "add-on" device to provide filtering to an already existing non-filtered connector. This is particularly desirable in instances when the same basic connector may be used in a number of different applications, each requiring filtering of different lines in the connector. It is also desirable that method be found to that will lend itself to automation of the assembly line by robotic devices and the like that will enable filtered connectors to be manufactured on a more cost effective manner.

SUMMARY OF THE INVENTION

In accordance with the present invention, an electrical component is provided which can be secured to an electrical article such as an electrical connector, the component being engageable to circuit paths of the article to providing filtering for those circuit paths. The electrical component is comprised of a dielectric housing member having a plurality of contact members secured therein and housing a plurality of filter receiving apertures along a first face thereof. The contact members have first and second contact portions, the first contact portion being engageable with a corresponding contact portion of said circuit paths of said article. The second contact portions are exposed along a bottom surface of the filter receiving apertures of the housing member. Third contact portions, paired with the second contact portions and spaced therefrom, are exposed along the bottom aperture surfaces of the housing member. The component further includes a bus means which extends outwardly from the third contact portion, the bus means being adapted to be engaged by grounding means of the electrical article. A plurality of filter members are disposed in respective apertures and electrically joined to respective pairs of second and third contact portions.

The electrical component of the invention is conected to an associated electrical article by electrically engaging the first contact portions to respective circuit paths of the electrical article and the bus means to a grounding means for the article. In the preferred embodiment the housing member of the electrical component is secured to an external surface of the electrical article.

It is an object of the present invention to provide electrical filtering means that can be externally mounted to an electrical connector or other electrical article.

It is another article of the invention to provide a filtering device that can be added on to an existing unfiltered connector.

It is a further object of the invention to provide an external filtering device that lends itself to automated assembly procedures.

It is another object of the invention to provide a filtering device which can be manufactured in a continuous strip.

Another object of the invention is to provide a method for manufacturing a filter device that may be used to retrofit existing connectors.

Furthermore, it is an object of the invention to provide a device for filtering connectors wherein the filtering device may be included on selective circuit paths.

The invention itself, together with further objects and its attendant advantages, will be best understood by reference to the following detailed description, taken in conjunction with the accompanying drawings.

DETAILED DESCRIPTION OF THE DRAWINGS

Figure 1:
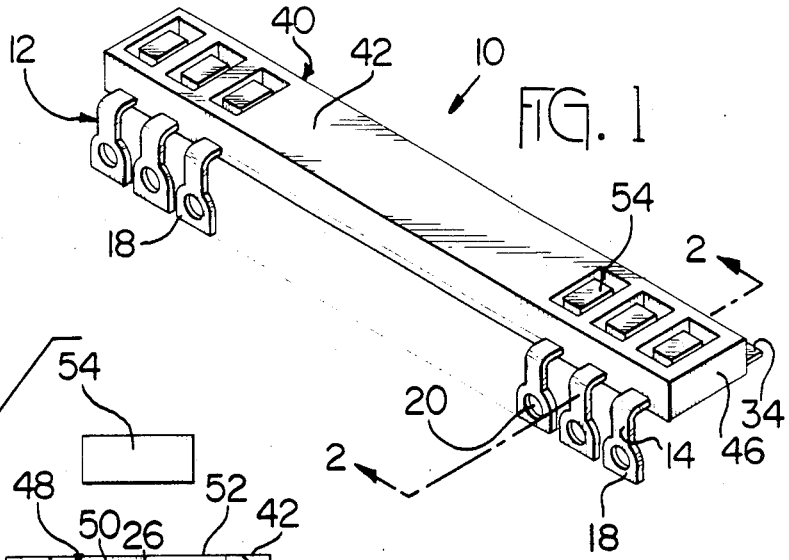
FIG. 1 is a perspective view of the electrical device of the present invention.
Figure 2:
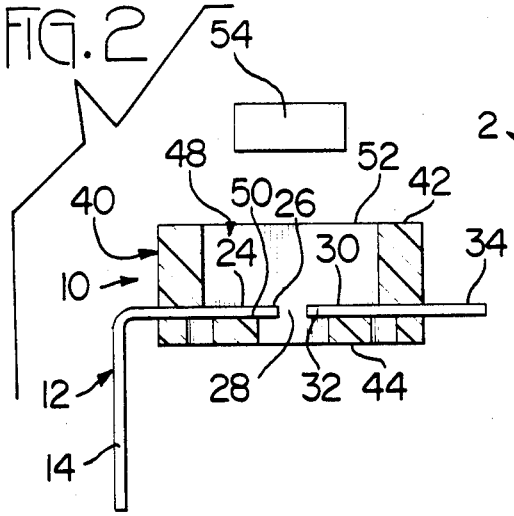
FIG. 2 is a cross-sectional view taken along line 2—2 of FIG. 1 with parts exploded therefrom.
Figure 3:
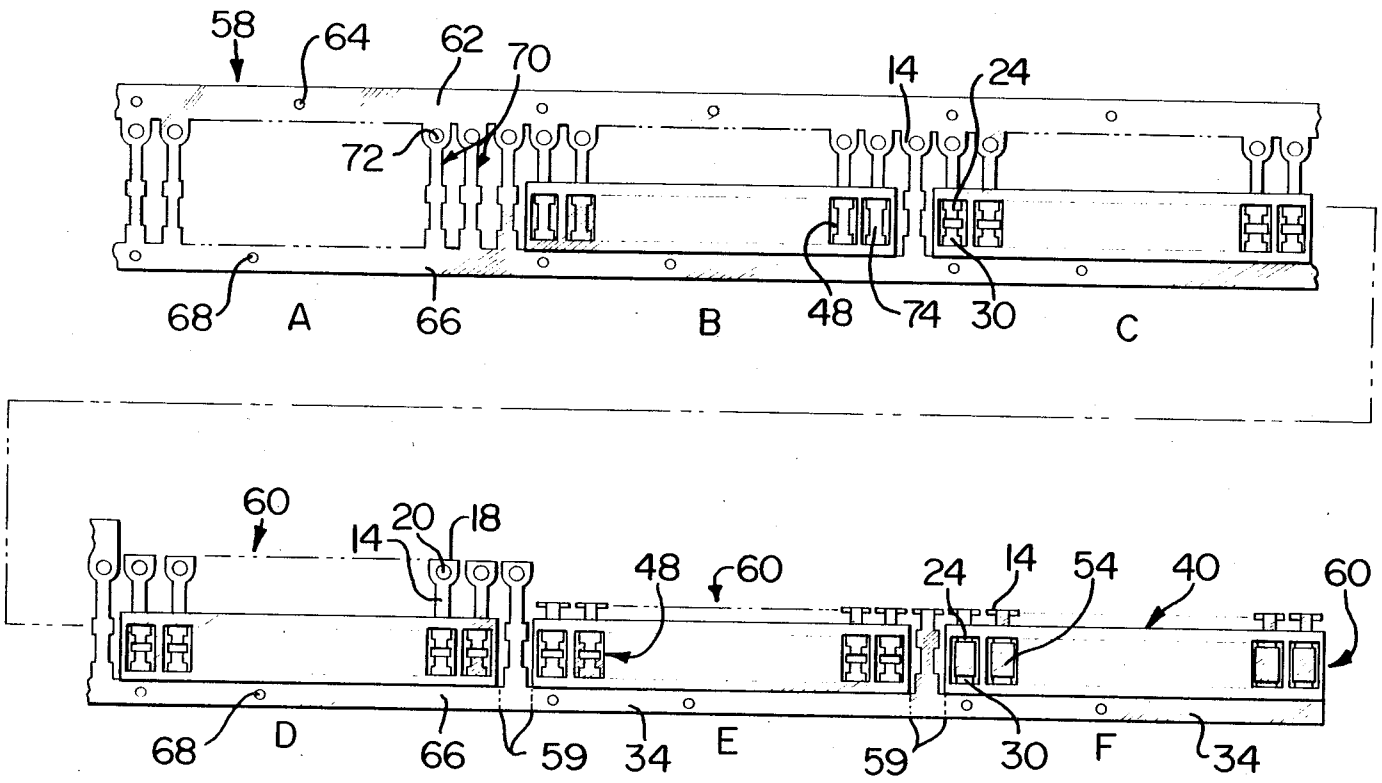
FIG. 3 illustrates the steps in a continuous process for making the device in accordance with the present invention.

Referring now to FIGS. 1, 2 and 3, a filtering device 10 is designed to be used with an electrical article to provide filtering for selected circuit paths of the articles. Device or component 10 is comprised of a plurality of contact members 12, a dielectric housing member 40 and filter members 54. Contact members 12 have first and second contact portions 14 and 24 respectively. First contact portions 14 are engageable with corresponding contact portions of an electrical article. First contact portions 14 are secured in the housing member 40. Dielectric housing member 40 includes a plurality of filter receiving apertures 48 along a first face 42 thereof. Second contact portions 24 are exposed along a bottom surface 50 of respective apertures 48. Third contact portions 30 paired with second contact portions 24 and are spaced therefrom at 28. Third contact portions 30 are also exposed along the bottom surface 50 of respective filter receiving apertures 48. Bus means 34 is secured in housing member 40, said bus means 34 extending outwardly from the third contact portion 30 and being adapted to be engaged by grounding means on an electrical article. A plurality of filter members 54 are disposed in respective filter receiving apertures 48 of housing member 40 and electrically joined to respective pairs of second contact portions 24 and third contact portions 30. Filter members 54 are surface mounted components, such as chip capacitors, resistors, unipolar or bipolardiodes or the like. First contact portions 14 further have connecting means 18 having aperture 20 therein for electrically connecting first contact portion 14 corresponding contact members of an electrical article as explained below.

As illustrated in FIG. 3, electrical device 10 preferably is made in continuous form by stamping and forming a plurality of lead frames 60 in strip 58 of suitable flat stock metal such as copper, phosbronze, or the like as known in the art. Strip 58 is first stamped to form first and second carrier strips 62, 66 having a plurality of essentially parallel cross bar members or contact means 70 extending between carrier strips 62, 66 as is shown in Frame A. Cross bar members 70 become contact member sections 14, 24 and 30 in the assembled device. Carrier strips 62, 66 have apertures 64 and 68 therein which are used for aligning strip 58 in the manufacturing and assembly process. If desired cross bar members 70 may be plated on the desired contact area.

Housing members 40 are then insert molded around portions of the stamped members, each housing encompassing the desired number of cross bar members. A plurality of filter receiving apertures 48 are also formed, one aperture 48 being associated with each cross bar member 70 within housing 40. In the preferred embodiment, housing members 40 are located and molded on strip 58 such that carrier strip 66 becomes bus bar 34 of severed device 10. The material used for molding the housings is preferable one that will withstand the temperatures associated with vapor flow soldering techniques. One preferred material is polyphenylene sulfide, available from Phillips Petroleum Co. under the trade name Ryton®. Other suitable materials are known in the art.

As is shown in Frame B, cross bar members 70 extend completely across apertures 48. In the next stage of manufacturing, shown in Frames C and D a portion of cross bar members 70 is removed at 74 to form the three contact portions 14, 24 and 30 of device 10. Concomitantly a portion of underlying dielectric housing material is also removed. Carrier strip 62 may be removed at the same time or during a subsequent step. It is to be understood that cross bar members 70 may be separated prior to insert molding, if desired, and that cross bar members 70 between adjacent housing members 40 may be severed at this time or when individual devices 10 are severed from the strip. First contact portions 14 are then bent and formed. Lastly, filter members 54 are mounted and preferably soldered in their respective apertures.

As shown in Frame F of FIG. 3, filtered devices 10 can be completely formed on the strip while remaining attached to carrier strip 66. The strip of filter devices can be rolled onto a reel (not shown) until device 10 is ready to be assembled to an electrical article. Individual devices 10 can be severed at 59 from strip as needed. As shown in FIG. 3 carrier strip 66 becomes bus bar 34.

The process for making device 10 lends itself to automation since strip 58 may be stamped and formed, rolled on a reel (not shown), and later formed into electrical devices 10 in accordance with the invention. The length of housing member 40 and the number of contact members 12 therein is determined at the time of molding strip 58 is stamped such that a plurality of differing length housing members 40 can be molded. In general the molding machine can be programmed to index selected number of cross bar members 70. Once housing members 40 have been molded, the strip is moved to a stamping station to stamp and form the device of the desired configuration. Insertion of the filter members 54 lends itself to pick and place robotic system. The well defined apertures 48 can be aligned so that the equipment can place filter members 54 between the second and third contact portions 24 and 30 at selected locations.

Figure 4:
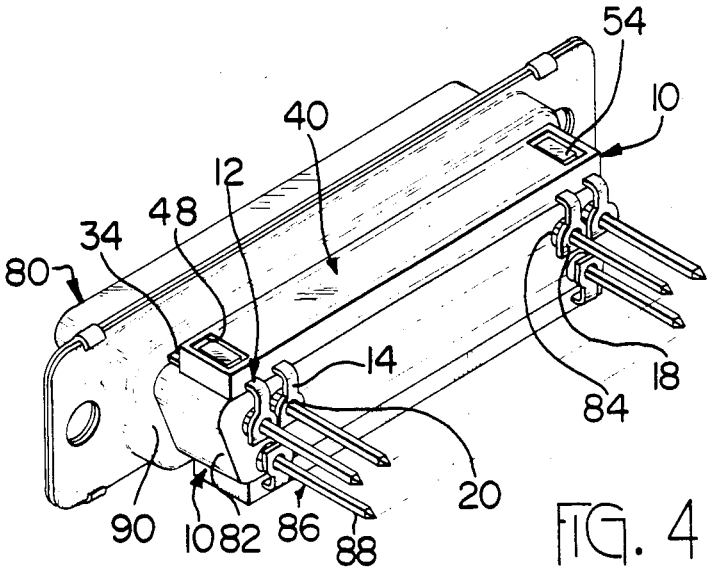
FIG. 4 is a perspective assembled view of an electrical connector assembly having the device of the present invention attached thereto.
Figure 5:
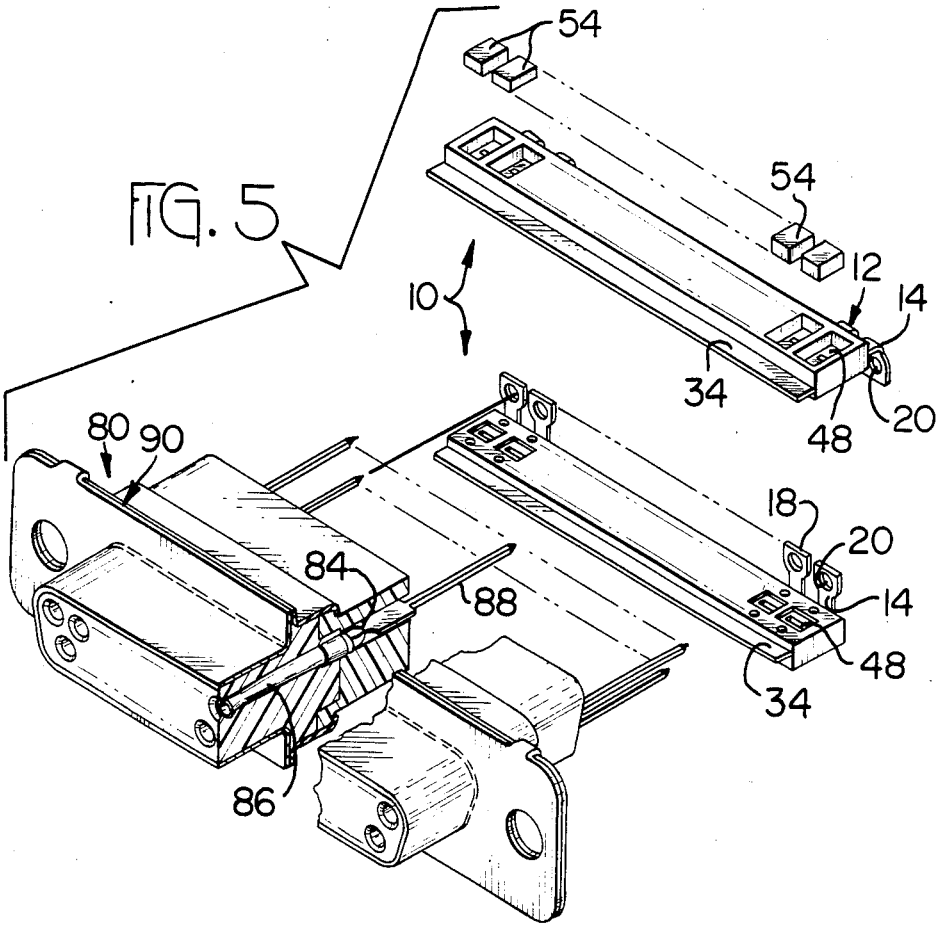
FIG. 5 is an exploded perspective view of the connector assembly of FIG. 3.

FIGS. 4 and 5 illustrate the use of device 10 with electrical connector 80 comprised of dielectric housing member 82 having a plurality of apertures 84 extending therethrough, a plurality of electrical terminal members 86 disposed in respective apertures 84, and conductive ground shell means 90. Terminal members 86 have terminal post sections 88 extending rearwardly of housing member 82. Device 10, in accordance with the preferred embodiment, has a generally rectangular housing member 40 having a plurality of filter members 54 preferably extending slightly outwardly from a plurality of filter receiving apertures 48. First contact portions 14 are bent at right angles so that device 10 can be mounted to an electrical connector housing 82 with each of the first contact portions 14 engaged with respective terminal posts 88. Bus bar 34 extends from the opposite side of housing and is designed to be engaged with a ground plane of the connector 80. In the example shown filter device 10 is mounted on the surface of the connector housing 82 such that bus bar 34 can be electrically connected to ground shell means 90 by solder. Apertures 20 in the first section of contact member 12 engage respective terminal post sections 88 of connector 80 and are soldered thereto. It is to be understood that this electrical connector is merely a representative sample of the types of connector with which this device may be used. It is to be further understood that other pin or socket terminals may also be used.

Connector 80 as disclosed in FIGS. 4, 5, has two rows of terminal members. It is, therefore, necessary to use two electrical devices 10 in accordance with the invention, one device being mounted to each side of connector housing 82, with first contact portions 14 of each device 10 electrically connected to only one row of the terminal posts 88 and respective bus bars 34 soldered to ground shell 90.

Figure 6:
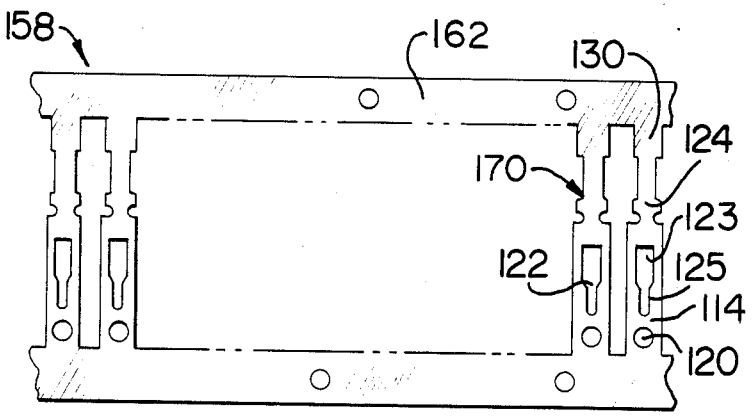
FIG. 6 is a plan view of a strip of alternative embodiment of contact members.
Figure 7:
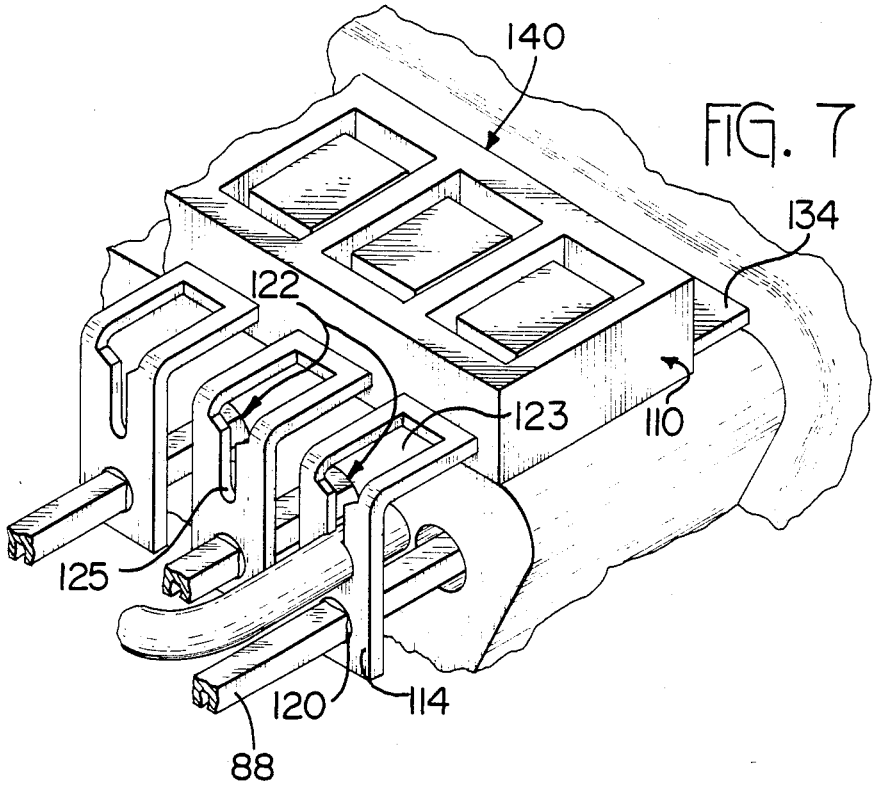
FIG. 7 is a fragmentary perspective view illustrating an alternative embodiment of the device having contact members of FIG. 6.

FIGS. 6 and 7 show an alternative embodiment 158 of stamped metal strip for forming lead frames for device 110. In this embodiment, the portion of cross bar member 170 that will become first contact portion 114 further includes a slot 122 having an enlarged portion 123 for receiving an insulated wire and a narrower portion 125 for piercing the insulated wire as can best be seen in FIG. 7. In the assembled device, slot 122 is located in first contact portion 114 between aperture 120 which receives terminal posts 88 and housing 140. Carrier strip 162 is severed to form bus bar 134, which extends from third contact portion 130. Otherwise device 110 is formed in the same manner as device 10 and is mounted to a connector in the same manner as previously described.

Figure 9:
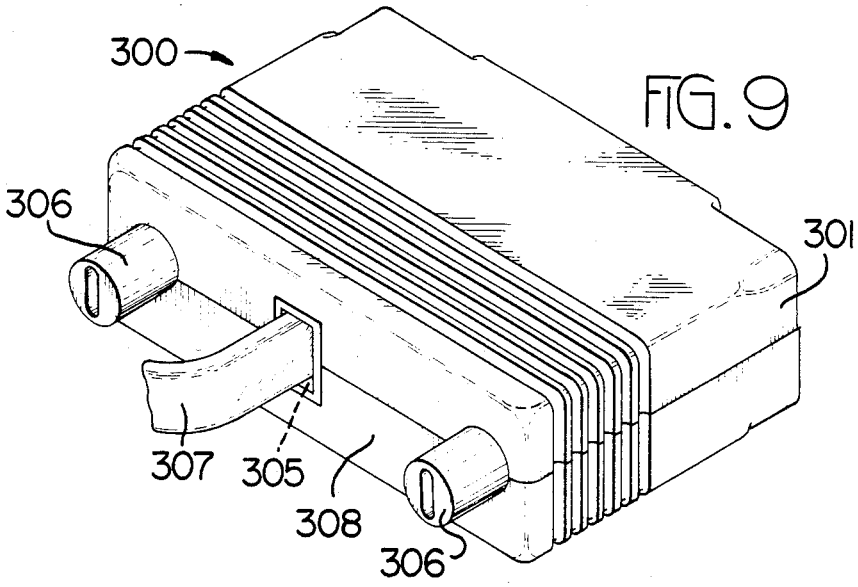
FIG. 9 is a perspective view of the assembled electrical connector of FIG. 8.
Figure 8:
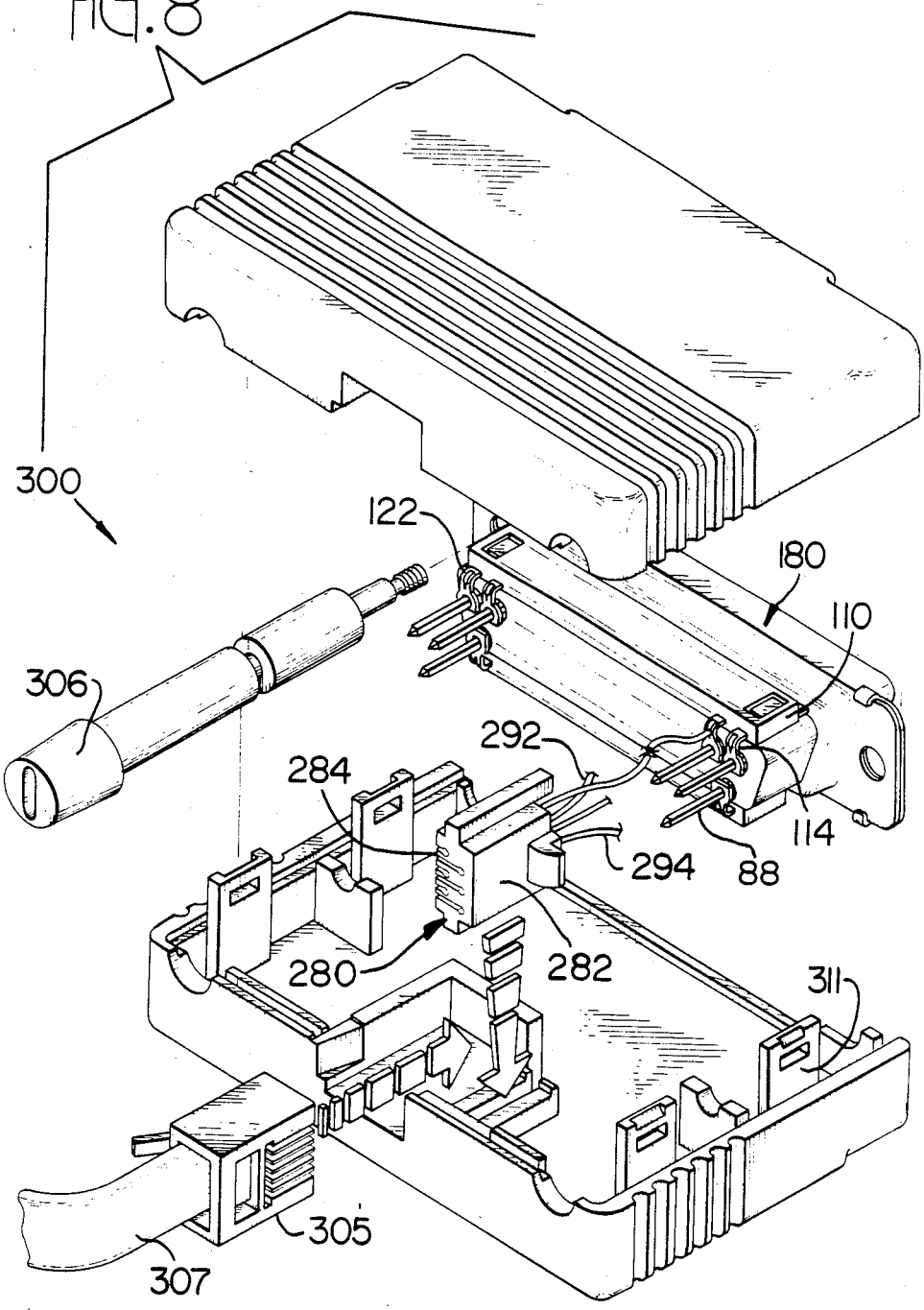
FIG. 8 shows the device of FIG. 7 used in an interconnection system between two electrical connectors.

FIGS. 8 to 9 illustrate electrical connector assembly 300 in which filtering device 110 is used as an interconnecting means to interconnect selected lines of a first connector 180 to lines of a second connector 280. Connector assembly 300 is comprised of first and second dielectric shell members, 301, 302, a first connector 180, filtering devices 110 secured to first connector 180, and a second connector 280. Selected terminal posts 192 of said first connector 180 are interconnected through filtering device 110 to lines 292 of the second connector. First connector 180 has the same general structure as connector 80 shown in FIGS. 4 and 5 and previously described. The difference between connector 80 and 180 is that filtering device 110 contains the lead frame embodiment of FIG. 6 wherein the first contact section 114 includes the wire terminating slot 122 as best seen in FIG. 7. Second connector 280 is comprised of a dielectric housing member 282 having a plurality of passageways 284 therethrough in which are disposed a plurality of terminal members (not shown). The terminal members are terminated to one end of conductor wire members 294 which extend rearwardly from housing member 282.

By terminating the other ends of wire members 294 in selected insulation displacement slots 122 of first contact portions, selected lines of first and second connectors 180, 280 can be interconnected. After the wires 294 have been terminated to the desired lines of connector 180, first and second connectors 180, 280 are encased in shell members 301, 302. In the representative embodiment shown in FIG. 8, shell members 301 and 302 are profiled to accept a modular plug 305 which will mate with connector 280. First and second shell members 301, 302 are secured together by means of snap features 311 molded into the shell members. Jack screws 306 are used to attach connector 300 to a complementary connector (not shown). FIG. 9 shows the completed compact package containing the two connectors and a modular plug 305 connected to cable 307 inserted into back 308 of connector assembly 300. Connector assembly 300 provides a relatively compact package and means for filtering an existing connector and for selectively filtering the interconnection between two connectors while maintaining the mating configuration of both connectors.

Figure 10:
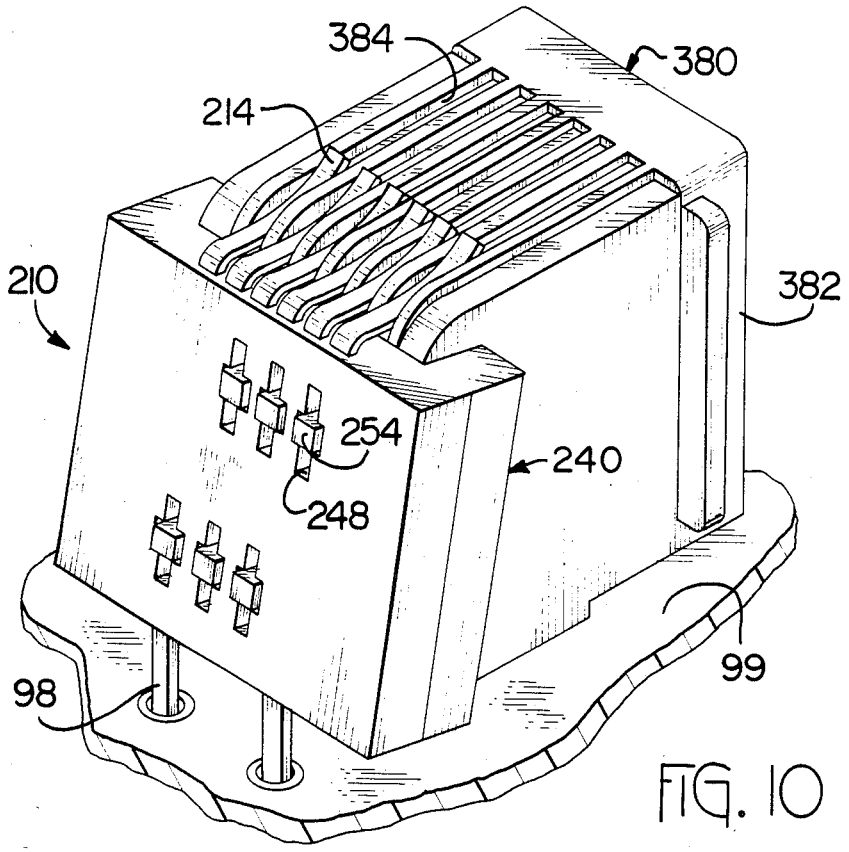
FIG. 10 is a perspective view showing a further alternative embodiment of the device of the invention mounted to an electrical connector.
Figure 10A:
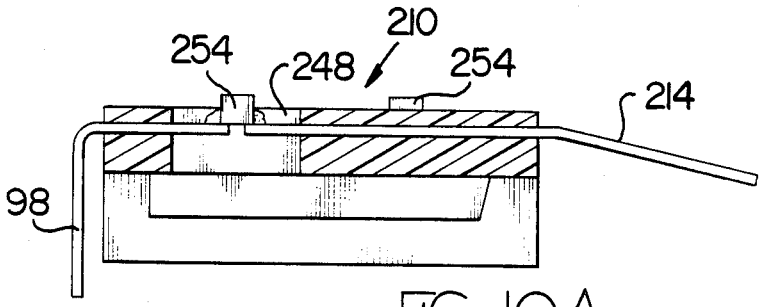
FIG. 10A is a cross-sectional view of the device of FIG. 10.
Figure 11:
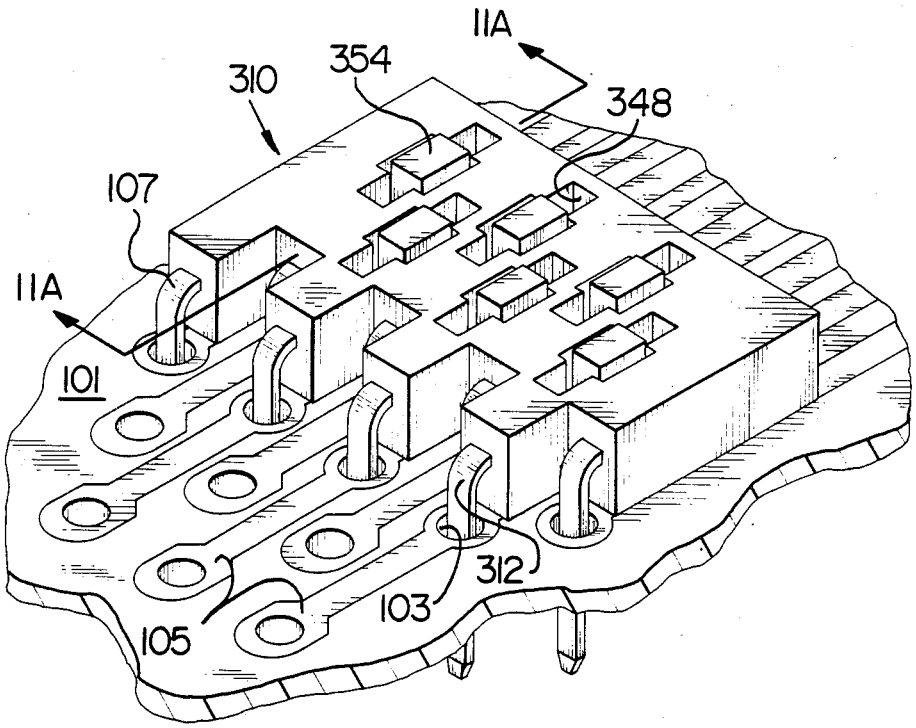
FIG. 11 shows another alternative embodiment of the device mounted to a printed circuit board.
Figure 11A:
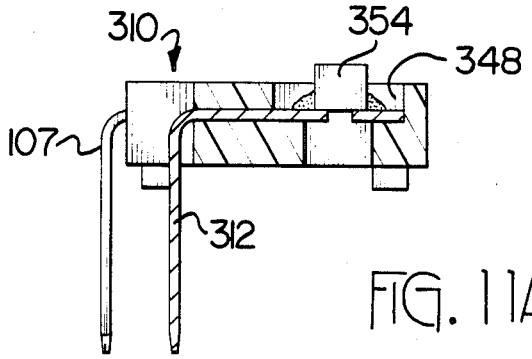
FIG. 11A is a cross-sectional view of the device of FIG. 11.

FIGS. 10 and 10A illustrate another connector 380, in this instance a modular jack, having alternative embodiment 210 of the filtering device of the present invention mounted to the back thereof. In this embodiment, first contact sections 214 are spring loaded against corresponding terminal members (not shown) of connector 380. The terminal members lie within respective passageways 384 in connector housing 382. Owing to the close spacing of contact sections 214 in terminal passageways 384, adjacent apertures 248 having filter members 254 therein are staggered in housing member 240. Grounding of filter device 210 is achieved through ground leg members 98 which extend from the lower end of device 210 and engage circuit conductors on circuit board 99 as can best be seen in cross-sectional view of FIG. 10A. In this version the sides of housing member 240 are expanded to snap fit onto the back of the modular jack. FIGS. 11 and 11A show a filter device 310 made in accordance with the invention for mounting directly to a circuit board 101 wherein the first contact sections 312 engage apertures 103 in the circuit board 101, apertures 103 being electrically connected to a circuit path 105 with which a further electrical connector may be engaged. Filter members 354 are placed in staggered apertures 384 owing to space limitations. The bus bar in this device is also connected to ground through leads 107 as shown in FIG. 11.

It is to be understood that the electrical connectors used with the present device are representative samples only. It is to be further understood that frame and shape and types of connectors with which this device may be used are numerous. By filtering electrical connectors with an externally mounted filtering device, it is possible to selectively filter lines by omitting filter members from the various apertures. This allows the same basic connector to be filtered readily, in a variety of configurations and in a cost effective manner. By making a filtered device in accordance with this manner, the filtering device lends itself to cost effective manufacturing process which includes automatic equipment such as pick and place robots. Lead frame technology and insert molding lend themselves to continued automated manufacturing process which minimize handling of the device as well as time and labor. The device uses small filtered capacitors, transient suppression diodes, resistors or other components that are designed to be in parallel with the circuit, between pin and ground. The components used for any one connector need not be identical and selected frequencies may be controlled by placing filter devices of varying capabilities at selected locations. The filter device of the present invention is designed for filtering in the lower frequency ranges, preferably not to exceed 500 megahertz.

It is thought that the filter device of the present invention and many of its attendant advantages will be understood from the foregoing description. It will be apparent that various changes may be made in the form, construction and arrangement of the parts thereof without departing from the spirit or scope of the invention or sacrificing all its material advantages. The form herein described is merely a preferred or exemplary embodiment thereof.

I claims:

1. An electrical component for being secured to an electrical article and electrically engageable to circuit paths thereof, for filtering said circuit paths comprising:

a plurality of contact members having first and second contact portions, said first contact portions being engageable with corresponding contact sections of said circuit paths of said article;

housing means to which said contact members are secured, said housing means including a plurality of filter receiving apertures along a face thereof, said second contact portions being exposed along a bottom surface of respective said apertures;

third contact portions paired with said second contact portions and spaced therefrom, said third contact portions being exposed along respective said bottom aperture surfaces;

bus means secured to said housing means and extending from said third contact portions, said bus means being adapted to be engaged by grounding means;

a plurality of filter members disposed in respective apertures and electrically joined to respective pairs of said second and third contact portions, and connecting means for electrically connecting said first contact portions to terminal members of said electrical article;

whereby when said first contact portions are engaged with respective terminal members of said electrical article and said bus means is engaged to said grounding means, said filter means provides filtering protection for said electrical article.

2. The electrical component as described in claim 1 wherein said filter members are surface mounted to said respective pairs of said second and third contact portions.

3. The electrical connector as described in claim 1 wherein said first contact portions extend outwardly from a side of said housing means.

4. The electrical component as described in claim 1 wherein said bus means extends outwardly from said housing means along a side thereof.

5. The electrical component as described in claim 4 wherein said first contact portions extend outwardly from a second side of said housing means, said second side being opposed from said first side.

6. The electrical component as described in claim 1 wherein said electrical article is an electrical connector and wherein said electrical component is mounted to an exterior housing surface of said electrical connector.

7. The electrical component as described in claim 6 wherein said circuit paths of said electrical connector include electrical terminal members having terminal posts.

8. The electrical component as described in claim 7 wherein said connecting means comprises an aperture in each of said first contact portions of said electrical component, said apertures being dimensioned to receive respective ones of said terminal posts of said electrical connector.

9. The electrical component as described in claim 6 wherein said bus means is secured to and extends outwardly from said housing means of said electrical component along a side thereof, said bus means being electrically engageable with a grounding means of said electrical connector.

10. The electrical component as described in claim 8 wherein said first contact portions of said electrical component are adapted to receive conductor means electrically engaged to circuit paths of another electrical connector, wherein selected terminal members of said electrical connector may be interconnected to selected circuit paths of said another electrical connector to provide filtering for the interconnected paths while maintaining the mating configuration of the two electrical connectors.

11. The electrical component as described in claim 1 wherein said electrical article is a circuit board.

12. An electrical component for being secured to an electrical article and electrically engageable to circuit paths thereof, for filtering said circuit paths, comprising:

housing means having filter receiving aperture means extending along a face thereof;

a plurality of contact members secured to said housing means along a side thereof, said contact members having first and second contact portions, said first contact portions extending outwardly from a first side of said housing means and being electrically engageable with correspoonding contact sections of said circuit paths of said electrical article, said second contact portions extending into said filter receiving aperture means and exposed along a bottom thereof;

third contact portions paired with said second contact portions and spaced therefrom, said third contact portions extending into said filter receiving aperture means and exposed along a bottom thereof;

bus means secured in said housing means and extending from said third contact portions, said bus means being adapted to be engaged by grounding means;

filter means disposed in said filter receiving aperture means and electrically joined to selected pairs of associated second and third contact portions, and connecting means for electrically connecting said first contact portions to said contact sections of said electrical article, whereby when said first contact portions are engaged with respective circuit paths of said electrical article and said bus means is engaged to said grounding means, said filter means provide filtering protection for said electrical article.

13. The electrical component as described in claim 12 wherein said filter means are surface mounted to said selected pairs of said second and third contact portions.

14. The electrical component as described in claim 12 wherein said filter receiving aperture means comprises a plurality of discrete filter receiving apertures, each having one pair of associated second and third contact sections therein.

15. The electrical component as described in claim 12 wherein said bus means is secured to and extends outwardly from said housing means along a second side thereof, said second side being opposed from said first side.

16. A strip of electrical components for filtering circuit paths of an electrical article, said strip comprising:

first and second elongate, essentially parallel carrier strip members having a plurality of essentially parallel cross bar members extending transversely therebetween, defining a plurality of lead frames, each lead frame comprising a group of said cross bar members to be processed into contact portions of said components and sections of said first and second carrier strip members attached to said group of cross bar members, said cross bar members having first, intermediate and second sections;

dielectric housing means molded over said intermediate section of each of said cross bar members of said lead frames, each said housing means being molded such that the intermediate sections of the cross bar members extend between and the first and second sections of said cross bar members extend outwardly from the major sides of said housing means, the first section of said cross bar members extending substantially outwardly from a first major side of said housing means defining first contact portions of said component upon later severing said component from said first carrier strip member, said second sections of said cross bar members extending a slight distance to said second carrier strip member such that said second carrier strip member lies proximately adjacent a second major side of said housing means;

filter receiving aperture means disposed in each of said housing means such that said intermediate sections of said cross bar members extend across the bottom of said aperture means, said intermediate sections when severed defining pairs of second and third contact portions for electrical engagement with filter means; and filter means disposed in said filter receiving apertures after said intermediate sections of said cross bar members are severed, said filter means being in electrical engagement with selected pairs of said second and third contact portions, said third contact portions extending to said second section of said cross bar members and thereby to said second carrier strip member, said second carrier strip member forming a common bus bar means outside said housing means upon severing said component and its associated section of said second carrier strip member from said strip of components.

17. The strip of electrical components as described in claim 16 wherein said filter means are surface mounted to said selected pairs of said second and third contact portions.

18. The strip of electrical components as described in claim 16 wherein said filter aperture receiving means comprises a plurality of discrete filter receiving apertures, each having one pair of associated second and third contact sections therein.

19. The strip of electrical components as described in claim 16 wherein each of said first contact portions of said electrical components include an aperture therein for receiving contact members of said electrical article.

20. A method of making a strip of electrical components for filtering circuit paths of an electrical article comprising the steps of:

stamping a strip of interconnected lead frames having first and second elongate, essentially parallel carrier strip members and a plurality of cross bar members extending transversely therebetween, each lead frame being comprised of a group of cross bar members to be processed into contact portions of one of said electrical component and sections of said first and second carrier strip members attached to said group of cross bar members, said cross bar members having first, intermediate and second sections;

molding a dielectric housing means over said intermediate section of each said cross bar member of said lead frames, each said housing means being molded over said cross bar members such that the intermediate section of each cross bar member extends between and the first and second sections of said cross bar members extend outwardly from the major sides of said housing means, the first sections of said cross bar members extending substantially outwardly from a first major side of said housing means defining first contact portions of said component upon later severing said component from said first carrier strip member, said second section of said cross bar members extending a slight distance to said second carrier strip member such that said second carrier strip member lies proximately adjacent a second major side of said housing means;

forming filter receiving aperture means in said housing means such that said intermediate sections of said cross bar members extend across the bottom of said aperture means;

severing said intermediate sections of said cross bar members in said aperture means to define pairs of second and third contact portions, said second contact portion extending to said first contact portion and said third contact portion extending to said second section of said cross bar member and thereby to said second carrier strip member, said second carrier strip member forming a common bus bar means outside said housing means upon severing said component and its associated section of said second carrier strip member from said strip of components;

selecting at least one location in said filter receiving aperture means for receiving filter means, said at least one location including an associated pair of second and third contact portions;

disposing said filter means in said filter receiving aperture means at said at least one selected location; and electrically connecting said filter means with said pair of second and third contact sections at said at least one location.

21. The method for making a strip of electrical components as described in claim 20 wherein said filter means are surface mounted to said pairs of said second and third contact portions in said selected locations.

22. A filtered adaptor for electrically interconnecting and selectively filtering circuit paths of a first electrical connector to selected circuit paths of a second electrical connector, while maintaining the mating configuration of both connectors, said first and second connectors having first and second terminal members therein, said adaptor comprising:

housing means having filter receiving aperture means extending along a face thereof;

a plurality of contact members secured to said housing means along a side thereof, said contact members having first and second contact portions, said first contact portions extending outwardly from said housing means and being electrically engageable with corresponding terminal members of said first electrical connector, said second contact portions extending into said filter receiving aperture means and exposed along a bottom thereof;

third contact portions paired with said second contact portions and spaced therefrom, said third contact portions extending into said filter receiving aperture means and exposed along a bottom thereof;

bus means secured in said housing means and extending from said third contact portions, said bus means being adapted to be engaged by grounding means of said first electrical connector;

filter means disposed in said filter receiving aperture means and electrically joined to selected pairs of associated second and third contact portions;

first connecting means for electrically connecting said first contact portions of said adaptor to terminal members of said first electrical connector; and second connecting means for electrically connecting said first contact portions of said adaptor to terminal members of said second electrical connector, whereby when said adaptor is mounted to an exterior surface of said first connector, and said first contact portions of said adaptor are electrically connected to respective terminal members of said first electrical connector, selected first contact portions can be electrically connected to terminal members of said second electrical connector, thus providing electrical interconnection and filtering of selected circuit paths of said first and second connectors.

23. The adaptor as described in claim 22 wherein said filter means is surface mounted to said second and third contact portions.

24. The adaptor as described in claim 22 wherein the number of terminal members of the first connector is different from the number of terminal members of the second connector.

25. An electrical component for being secured to an electrical connector and electrically engagable to at least one circuit path thereof, for providing filtering between said at least one circuit path and grounding means comprising:

at least one contact member having first and second contact portions, said first contact portion being engagable with said at least one circuit path;

housing means to which said first contact member is secured, said housing means including at least one filter receiving aperture along a face thereof, said second contact portion being exposed along a bottom surface of said at least one aperture;

a third contact portion paired with said second contact portion and spaced therefrom, said third contact portion being exposed along said bottom aperture surface;

a fourth contact portion secured in said housing and extending from said third contact portion, said fourth contact section being adapted to be engaged by said grounding means;

a filter member disposed in said at least one aperture and electrically joined to said pair of said second and third contact portions, and connecting means for electrically connecting said first contact portion to said at least one circuit path and for connecting said fourth contact portion to said grounding means whereby when said first contact portion is engaged with said at least one circuit path of said connector, and said fourth contact portion is engaged with said grounding means, said filter means provides filtering protection for said electrical circuit path.

26. The electrical component as described in claim 25, wherein said fourth contact portion includes a bus means.

* * * * *